US007287555B2

(12) United States Patent
Heger et al.

(10) Patent No.: US 7,287,555 B2
(45) Date of Patent: Oct. 30, 2007

(54) DISPENSER ASSEMBLY FOR A REFRIGERATOR DOOR

(75) Inventors: Bernd Heger, Augsburg (DE); Mac McMillan, Pinehurst, NC (US); Peter Nalbach, Kirchheim unter Teck (DE); Matthew Ricket, New Bern, NC (US); Ernest Spangler, Charlette, NC (US)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 8 days.

(21) Appl. No.: 11/290,034

(22) Filed: Nov. 30, 2005

(65) Prior Publication Data

US 2007/0119516 A1 May 31, 2007

(51) Int. Cl.
*B65B 1/04* (2006.01)

(52) U.S. Cl. ..... 141/86; 141/351; 141/378; 141/362; 62/389

(58) Field of Classification Search ..... 141/86–88, 141/82, 369, 378, 362, 360, 351; 222/146.6, 222/505; 312/292, 405; 62/389–400; 193/45
See application file for complete search history.

(56) References Cited

U.S. PATENT DOCUMENTS 5,507,329 A * 4/1996 Shub ..... 141/351
5,526,854 A * 6/1996 Unger ..... 141/351
5,782,380 A * 7/1998 DiSanto ..... 222/2
7,137,272 B2 * 11/2006 Park et al. ..... 62/389

* cited by examiner

*Primary Examiner*—Steven O. Douglas
(74) *Attorney, Agent, or Firm*—Russell W. Warnock; Craig J. Loest; James E. Howard

(57) ABSTRACT

A dispenser assembly for a door of a refrigerator includes a tray of flap construction which is moveable between a first position and a second position. In the first position the tray is received within a cavity of the dispenser assembly to present a support surface for a container such as a water glass. The tray is pivotable into a second position outside of the dispenser assembly so that an area normally underneath the tray is open to provide a second support surface for supporting larger containers than is possible with the tray in its first position. The now exposed bottom of the flap provides a third support surface outside of the cavity. The dispenser assembly can be used for dispensing water, ice, combinations thereof and may include lighting and other features. In an alternative construction, when the tray is pivoted into the second position, it is also forced out and away from the cavity of the dispenser assembly through a tray drive mechanism to accommodate different thicknesses of walls for a variety of different refrigerator door panels.

15 Claims, 11 Drawing Sheets

LEFT SIDE GEAR ASSEMBLY

RIGHT SIDE GEAR ASSEMBLY

DISPENSER ASSEMBLY FOR A REFRIGERATOR DOOR

FIELD OF THE INVENTION

This invention relates to a dispenser assembly for a door for a refrigerator, freezer, wine cooler or other type cooler, which is adaptable for receiving conventional size smaller containers therein, as well as larger containers which are ordinarily too large to fit into such a dispenser housing. In a more specific aspect, the invention relates to a dispenser assembly for use with multiple size containers in refrigerators having varying thicknesses of door panels.

BACKGROUND OF THE INVENTION

Most present constructions for refrigerators typically include a system for producing refrigerated water and ice which can be dispensed without requiring opening of the door to the refrigerator and entry into the interior thereof. Such systems typically include a water supply to the interior of the refrigerator which is cooled and/or formed into ice which through a dispenser arrangement can be dispensed through the wall of the refrigerator and through a door dispenser assembly. Such door dispenser assemblies are typically of a fixed size and can only accommodate containers up to a predetermined size. The dispenser assemblies discussed typically include a refrigerator door compartment which is open towards the refrigerator exterior, and contains a cavity and underlying support surface for supporting a glass or like container to be filled with refrigerated water and/or ice.

From an aesthetics perspective, the prior dispenser assemblies have been manufactured to be of limited size so as to not present a visually unpleasant large cavity in the door of the refrigerator. A problem with such construction is that when it is desired to dispense water into larger containers, for example, larger than conventional drinking glasses such as pitchers, etc., the door dispenser assembly cannot be used for such purposes.

Accordingly, and in accordance with the invention, the disadvantages of the prior constructions as discussed previously are avoided as is described with reference to the invention in greater detail herein.

BRIEF SUMMARY OF THE INVENTION

In accordance with one aspect of the invention, there is provided a door dispenser assembly, in particular, for use with refrigerators, freezers and/or wine coolers. The door dispenser assembly includes a housing having a cavity therein for receiving a container for having a substance dispensed into the container. A control mechanism for the housing serves to control dispensing of substances such as water and/or ice dispensed by the housing. A dispenser is associated with the control mechanism for dispensing the substances therefrom. A tray or flap is provided which is pivotable between a first position and a second position. In the first position, the tray or flap is received in the cavity of the housing and provides a support surface at an upper level for a container to be supported thereon. Such an upper level support accommodates containers such as a conventional drinking glass. The tray or flap is pivotable into a second position in which the tray or flap is pivoted to be outside of the housing and with the support surface thereof removed from the cavity, to provide additional clearance in the cavity for allowing a larger container to be supported within the cavity at a lower level than the upper level within the cavity. Such a support location serves to accommodate larger containers such as taller glasses and/or even small pitchers. Further, pitchers or larger containers can be supported on the outside of the cavity in a third support location on the flap extending outside the cavity.

In a more specific aspect, the door dispenser assembly includes the support surface of the tray being perforated to allow dispensed substances which may be in liquid form to pass therethrough. The housing has a support surface therein which provides the support surface at the lower level for a container.

In a more specific construction, the tray or a flap construction is of an L-shape with one of the legs of the tray or flap presenting the support surface when in the first pivoting position, and the other leg of the tray or flap presenting a front panel of the housing when in the first pivoting position. In a yet still more specific aspect, the tray is constructed to have a gap at an end connecting to the housing to provide a sufficient clearance when the tray is rotated into the second pivoting position sufficient to clear the housing of the dispenser assembly.

In an alternative construction, there is provided a door dispenser assembly which includes a housing having a cavity therein for receiving a container for having a substance dispensed into the container. A control mechanism for the housing serves for controlling dispensing of substances dispensed thereby, and a dispenser is associated with the control mechanism for dispensing the substances therethrough. A tray or flap mechanism is provided with a tray or flap pivotable between a first position in which the tray or flap is received in the housing and provides a support surface at an upper level for a container to be supported thereon, and a second position in which the tray is pivoted outside of the housing with the support surface removed from the cavity to provide additional clearance for allowing a container to be supported within the cavity at a lower level. The flap in the second position provides the third support surface. The tray mechanism further includes a drive for causing the tray to be moved out and away from the cavity at its connection thereto when pivoted from the first position into the second position. By so forcing the tray along with the support thereof out from the cavity, such a construction can be accommodated for different refrigerators having different door panel thicknesses such that a standard size construction for such door dispenser assembly can be employed in a multitude of different front panel sizes.

In a more specific aspect, the tray mechanism includes a tray gear housing received in the cavity and having a pair of gear drives respectively located adjacent to sides of the cavity. The tray is connected to the gear drives and the tray gear housing in a manner in which the tray is received within the cavity with the portion providing the support surface at an upper level located at about the top of the tray gear housing, such that when the tray is moved into the second pivoting position, the tray is forced a predetermined distance away from the cavity and the tray gear housing by the drive gears. This is caused by the pivoting into the second position which causes the tray to be moved and project out a predetermined distance from the tray gear housing and the cavity. The amount that the tray and the gear drives project outwardly depends on the thickness of the door panel with which the dispenser assembly is used, and can be set at a predetermined distance with appropriate stops as will be apparent to those of ordinary skill.

BRIEF DESCRIPTION OF THE SEVERAL VIEWS OF THE DRAWING

Having thus briefly described the invention, the same will become better understood from the following detailed discussion, made with reference to the appended drawing, wherein.

DETAILED DESCRIPTION OF THE INVENTION

Figure 1:
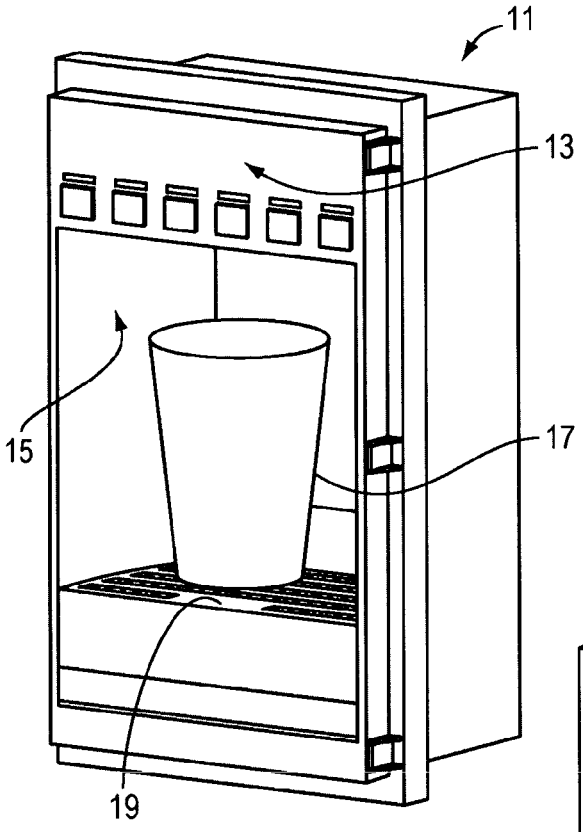
FIG. 1 is a perspective view of a first embodiment of a door dispenser assembly, shown with a tray thereof in a first position.

FIG. 1 illustrates in perspective view a first embodiment of a door assembly dispenser 11, for example, for use in a refrigerator door, for dispensing various substances therethrough including, but not limited to water, ice in block form, crushed ice, etc., and for providing varying levels of illumination therein. The door dispenser assembly 11 includes a control panel 13 including a number of control buttons to allow selection of the dispensing mode of water and/or ice and other functions known to those of ordinary skill. A cavity 15 is provided with a tray shelf 19 of a tray or flap 21 for supporting a container 17 therein.

Figure 2:
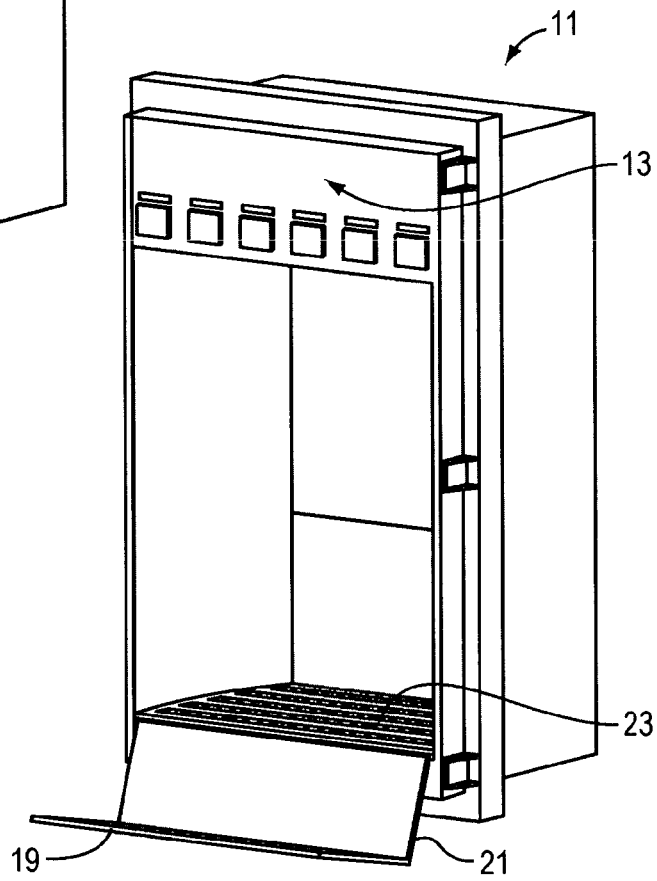
FIG. 2 is a view as in FIG. 1, but with the tray in the open position to allow larger containers to be received in the assembly.

The tray shelf 19 provides a first supporting surface 20 for the container is part of the tray or flap 21 which is of L-shaped construction, and which can be pivoted out from the cavity 15 from a first position as shown in FIG. 1, to a second position as shown in FIG. 2. When pivoted into the second position, the tray 21 opens a larger space in the cavity 15, which provides a second bottom support surface 23. In this position, the cavity 15 of the dispenser assembly 11 can accommodate larger containers supported on the second support surface 23 which makes up a floor of the cavity 15. A third support surface 20 is provided by a surface of the shelf 19 for supporting pitchers or other tall containers which are too tall for the cavity 15 even in the second position. Optionally, a drip tray can be supported on the support surface 23. In the event dispensed water, for example, misses the container 17, when the tray 21 is in the first position as shown in FIG. 1, the support surface 19 thereof can be perforated to allow the water to flow therethrough and on to the drip tray which can be supported on surface 23.

Figure 3:
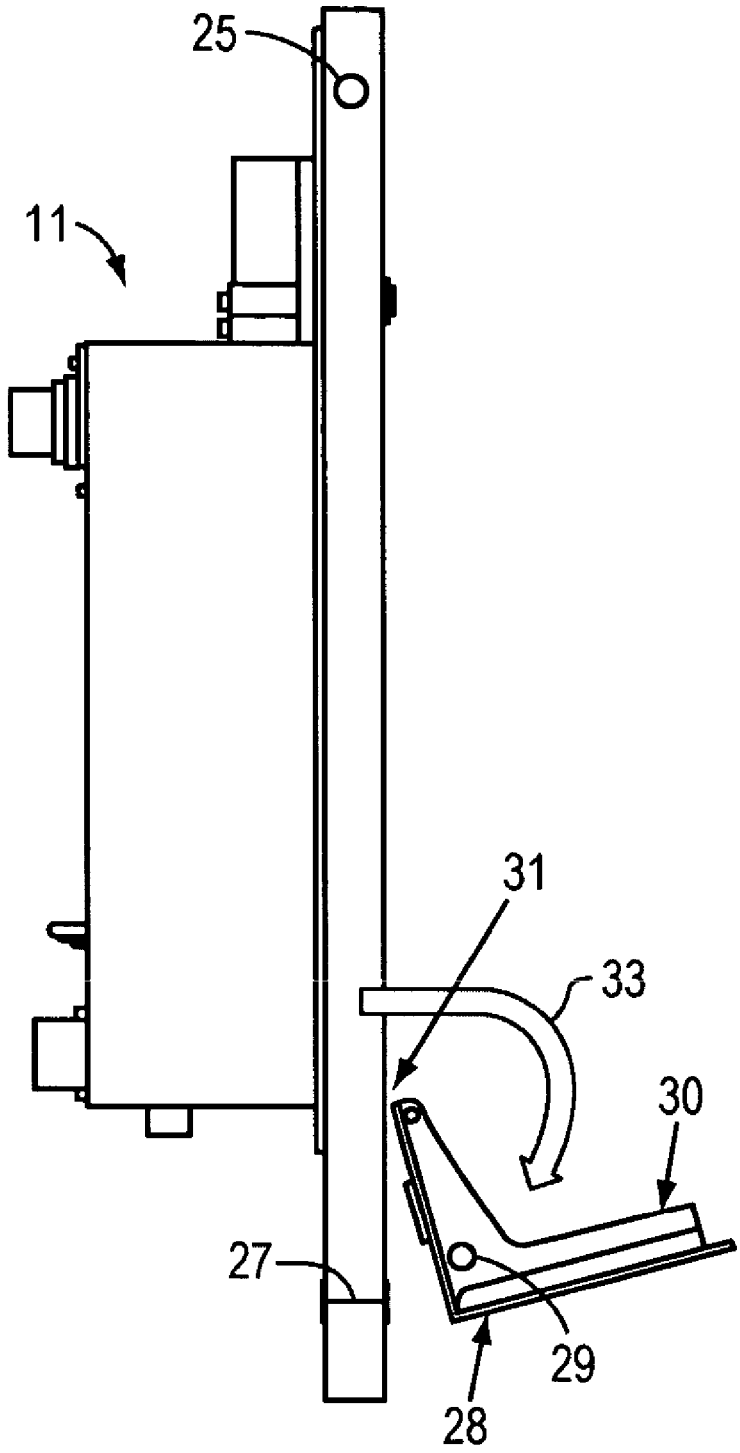
FIG. 3 is a side view of a second embodiment of a door dispenser assembly showing a tray thereof in a second position, and with a spacing gap on the tray to allow the tray to have sufficient clearance to rotate out and clear of the dispenser housing.

FIG. 3 shows an alternative embodiment for the dispenser assembly 11. The dispenser assembly 11 is mounted in a door panel 25, for example, of a refrigerator, typically on the freezer side to easily dispense ice. The door panel 25 has a predetermined depth 27, in many cases typically about 20 mm in thickness. In this case the tray is shown as a removable tray 29 and a clearance gap 31 is provided on the back edge of the tray 29 to ensure that the tray 29 has a proper clearance when pivoted out from the cavity 15 of the dispenser assembly 11 in the direction of an arrow 33. Again, the first dispensing position is provided with the tray 29 in the cavity (not illustrated) on the top surface 28 of the tray 29. The second dispensing position is inside the cavity 15, as illustrated in FIG. 2. The third dispensing position is provided on the bottom surface 30 of the tray 29 outside the cavity 15, in the position illustrated in FIG. 3.

Figure 4:
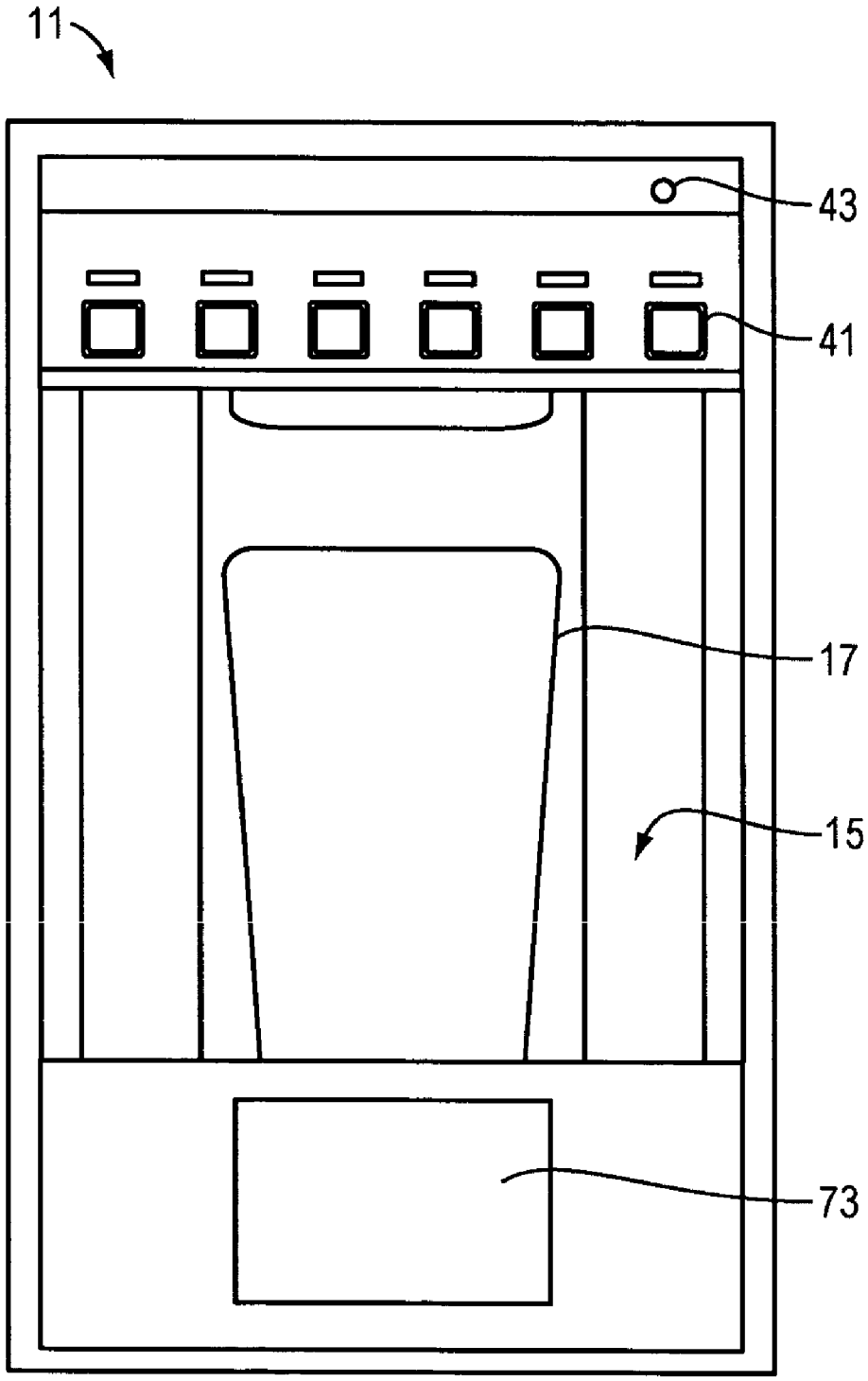
FIG. 4 is a front plan view of a door dispenser assembly shown with its tray in the first position and with a container accommodated therein.

FIG. 4 is a front view of the dispenser assembly 11 shown with a container 17 within the cavity 15 thereof. The control buttons 41 are shown for controlling a dispenser associated therewith and including a dispensing chute (not shown) associated with and in part within the dispenser assembly 11. A decorative metal strip 43 can be provided as well as a name plate on the tray which can, be visibly seen when the tray is in its first pivoting position.

Figure 5:
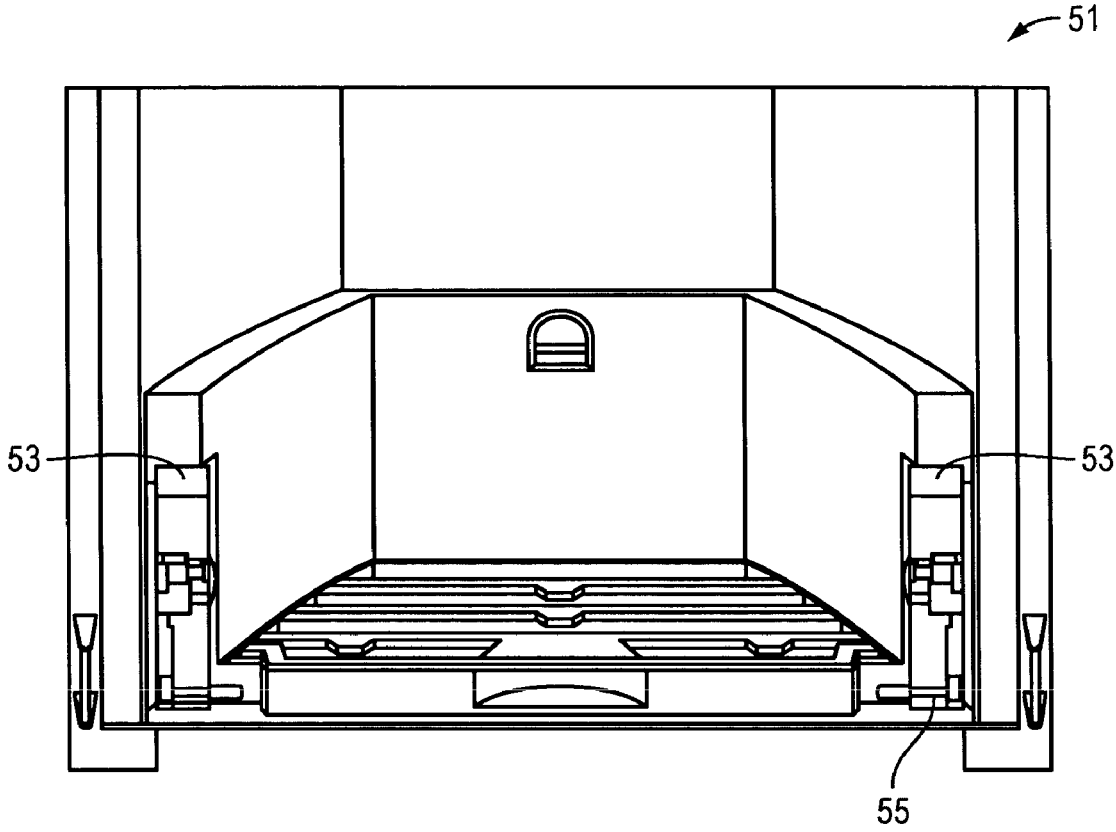
FIG. 5 is a front plan view of a tray or flap gear housing shown with gear drives assembled therein.

FIG. 5 is a front plan view of a flap or tray gear housing 51 for use in a yet still alternative embodiment of the dispenser assembly 11 in accordance with the invention. The flap or tray gear housing 51 and its operation within the dispenser assembly 11 will become better understood as described hereafter. As shown in FIG. 5, the flap or tray gear housing 51 includes a pair of gear mechanisms, i.e., a right and left gear mechanism 53, with a removable drip tray 55 shown therein.

Figure 6:
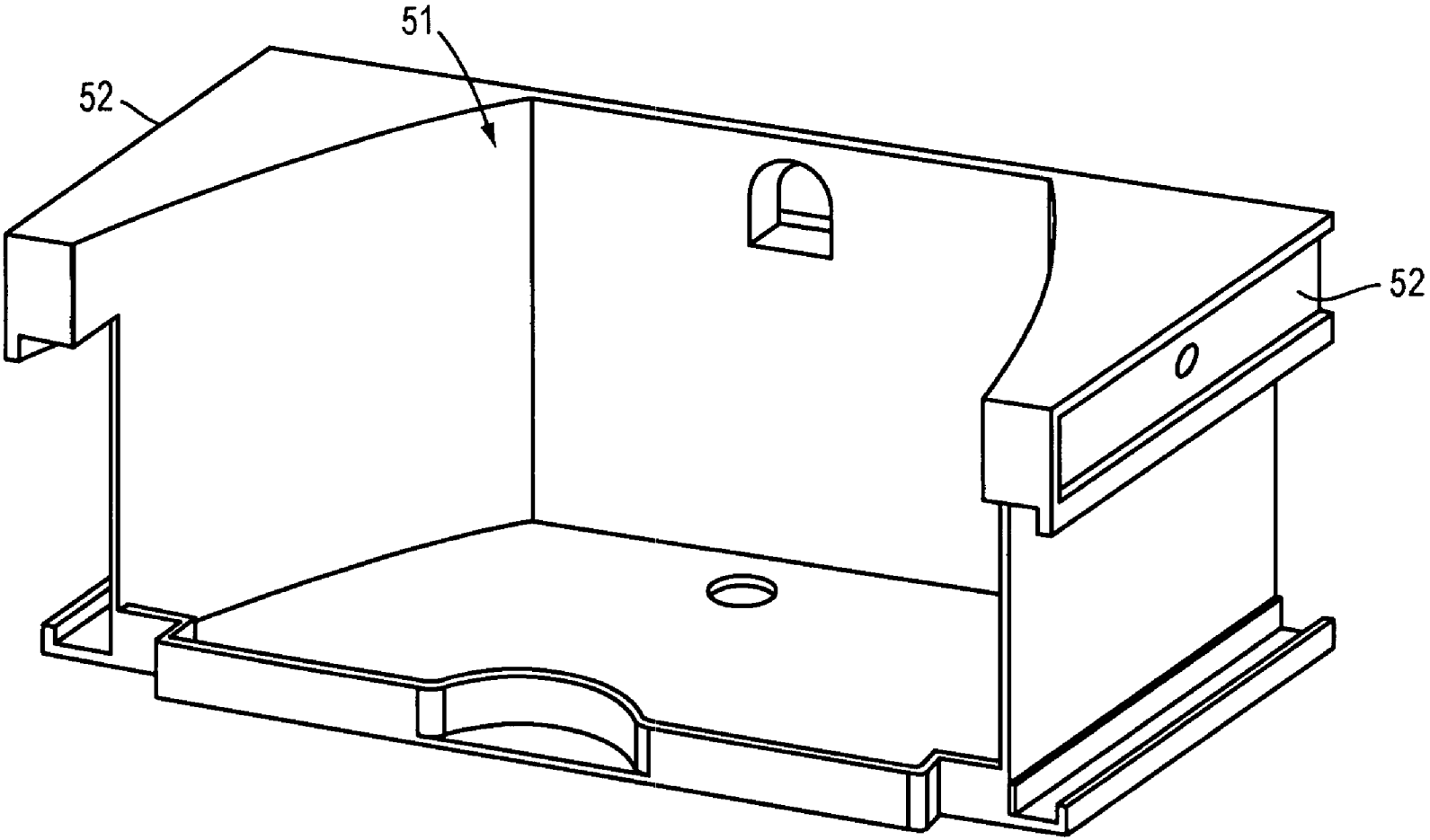
FIG. 6 is a perspective view of a tray or flap gear housing.

FIG. 6 is a perspective view of the flap or tray gear housing 51 without the gear mechanisms 53 and drip tray 55 therein. The housing 51 also shows partially enclosed regions for receiving fixed gear beams 81 therein as will be described hereafter. It should be noted that the flap or tray gear housing 51 is removable from the dispenser assembly 11 to facilitate cleaning.

Figure 7:
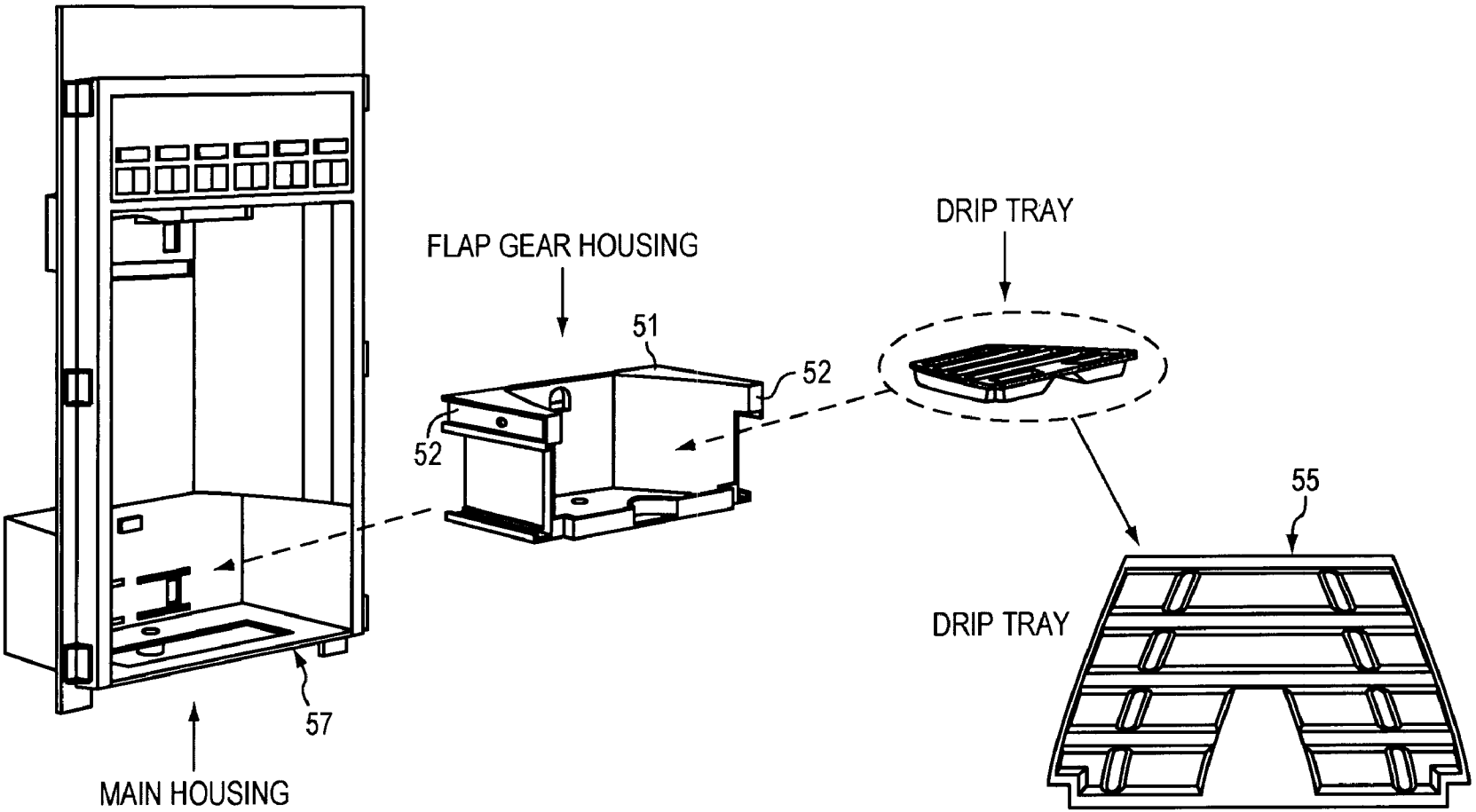
FIG. 7 is a disassembled view of a portion of the components of the dispenser assembly showing a main housing, a tray or flap gear housing, and a drip tray, and also showing the drip tray in enlarged form.

FIG. 7 illustrates in greater detail how the flap or tray gear housing 51 fits within a main housing 57 of the dispenser assembly 11.

Figure 8:
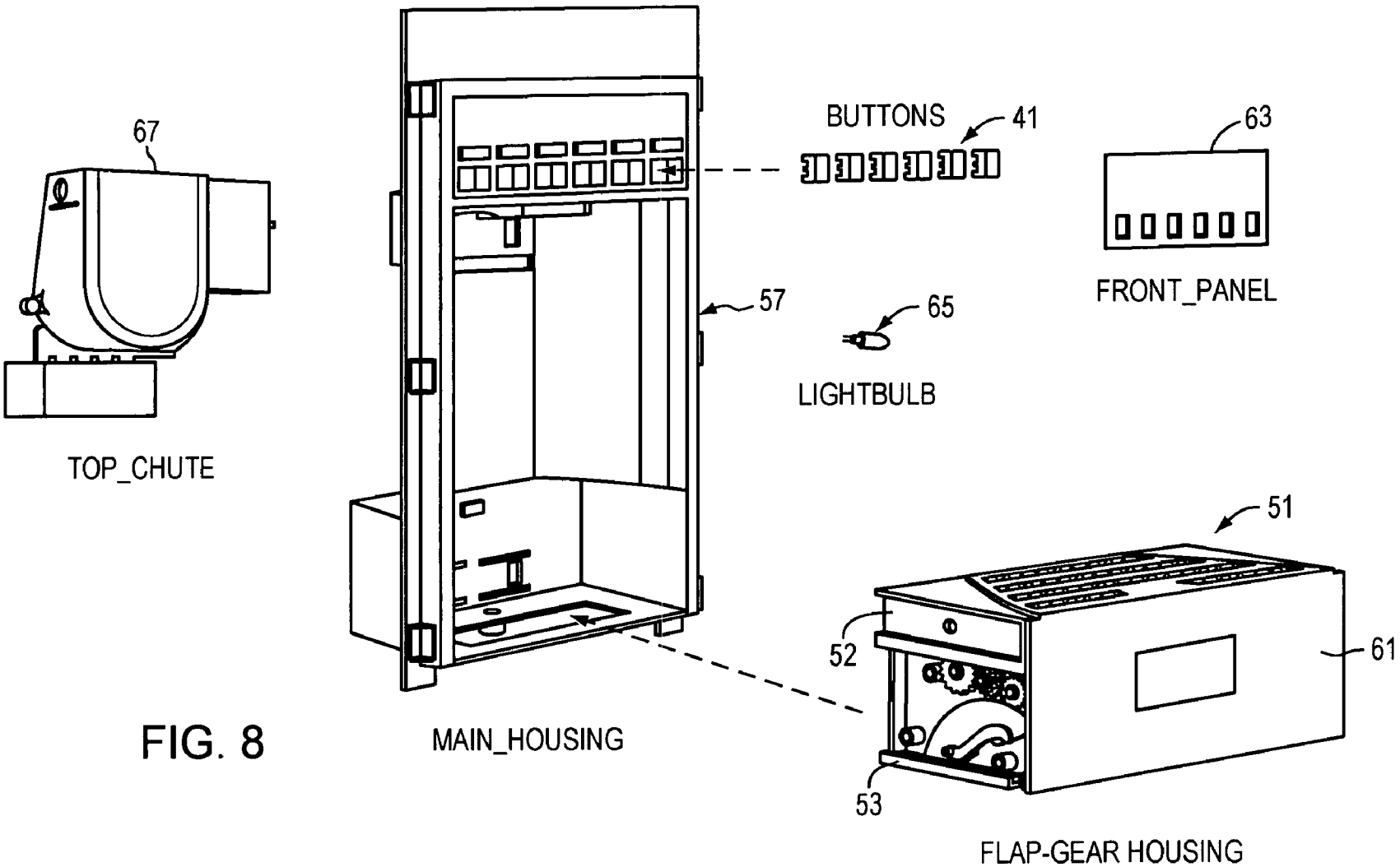
FIG. 8 is a view similar to that of FIG. 7 but also showing the tray or flap gear housing assembled, and various other components of the dispenser, including a dispensing chute which is to be assembled with the dispenser assembly.

FIG. 8 illustrates in yet greater detail various other components of the dispenser assembly 11. In this case the flap or tray gear housing 51 is shown with the gear mechanisms 53 mounted therein and showing a tray 61, similar to trays 21 and 29 of FIGS. 1-3, in the first pivoting position. As may be appreciated, the flap or tray gear housing 51 is received within the main housing 57 which also includes a light bulb 65 or other illumination device for providing lighting, and control buttons 41 associated with a front panel 63 for controlling dispensing of substances and lighting of the unit. As will appreciated, the control buttons 41 are associated with an appropriate control mechanism as will readily apparent to those of ordinary skill which can control the dispensing so that the dispensing assembly 11 can dispense water, crushed ice, ice in blocks, turn on the light bulb, etc. as will be readily apparent to those of ordinary skill in the art. Preferably the control buttons 41 are backlit, for example, through appropriate LCD lighting. A dispenser 67 including a top chute is associated with the dispenser assembly 11 for dispensing substances therethrough. The dispenser chute 67 is illustrated in general form and can be conventional in nature and of the type well known to those of ordinary skill in the art.

Figure 9:
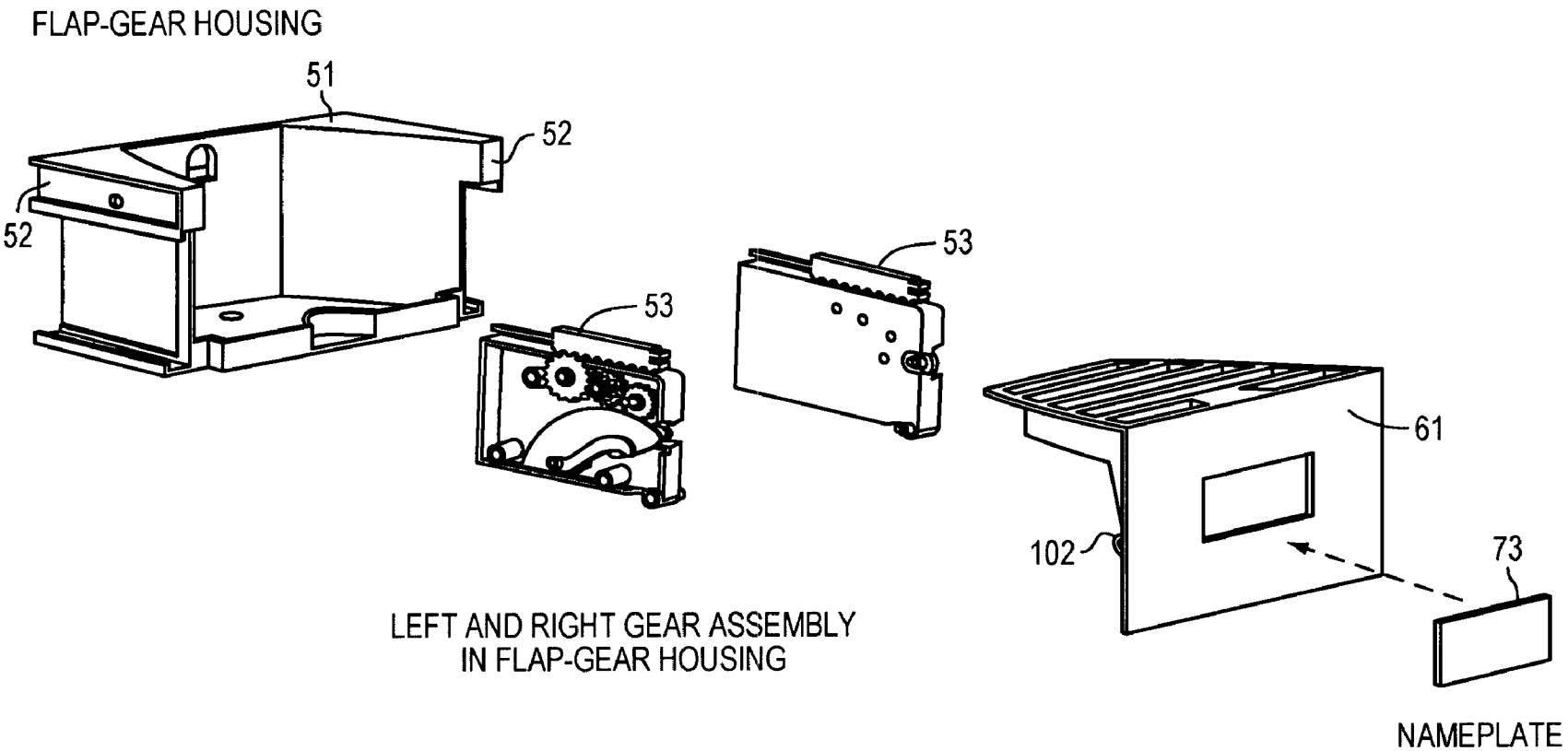
FIG. 9 is a disassembled view of a tray or flap gear housing showing the gear assemblies and the tray or flap.

FIG. 9 shows in disassembled form the flap or tray gear housing 51, the gear mechanisms 53 and the tray 61, which for decorative purposes when in the first pivoting position can include a logo or nameplate 73 adhered thereon or otherwise attached thereto.

Figure 10:
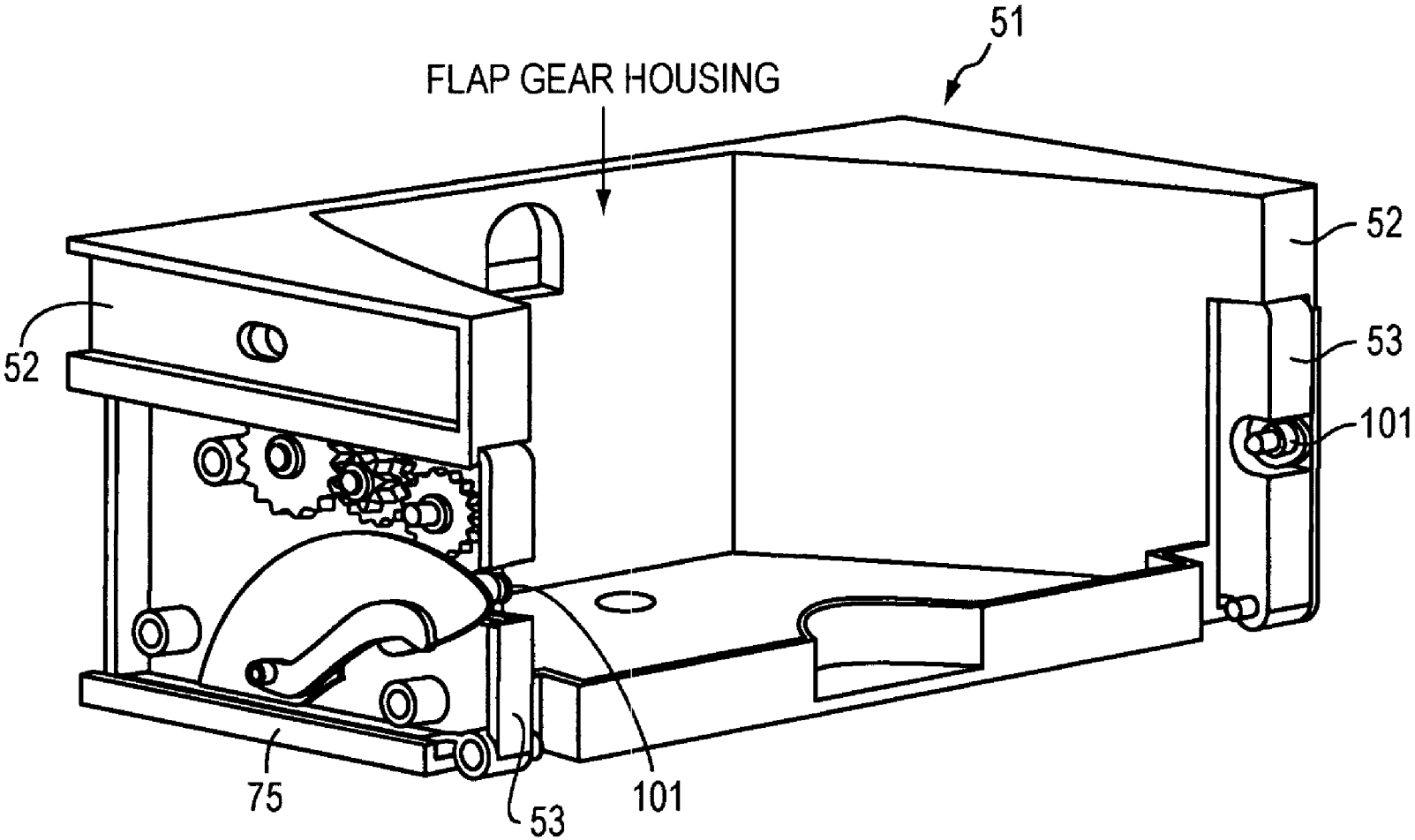
FIG. 10 is an assembled view of the tray or flap gear housing showing the gear drives assembled therein.

FIG. 10 shows the flap or tray gear housing 51 assembled with the gear mechanisms 53 therein and showing the gear mechanisms 53 with a back panel 75 attached thereto which includes a projection or pin member 101 on each side for engaging with a corresponding receiving opening member 102 of the tray 61 shown in FIG. 9. By such engagement, the tray 61 can be held on the flap or tray gear housing 51 and pivoted from its first position to its second position as previously described, and in the same manner engages with the gear mechanisms 53 to cause the gear mechanisms 53 to move outwardly from the tray or flap gear housing 51 in a manner of operation as will be described with reference to FIGS. 11 and 12, which respectively show the left side gear assembly 53 and the right side gear assembly 53'.

Figure 11:
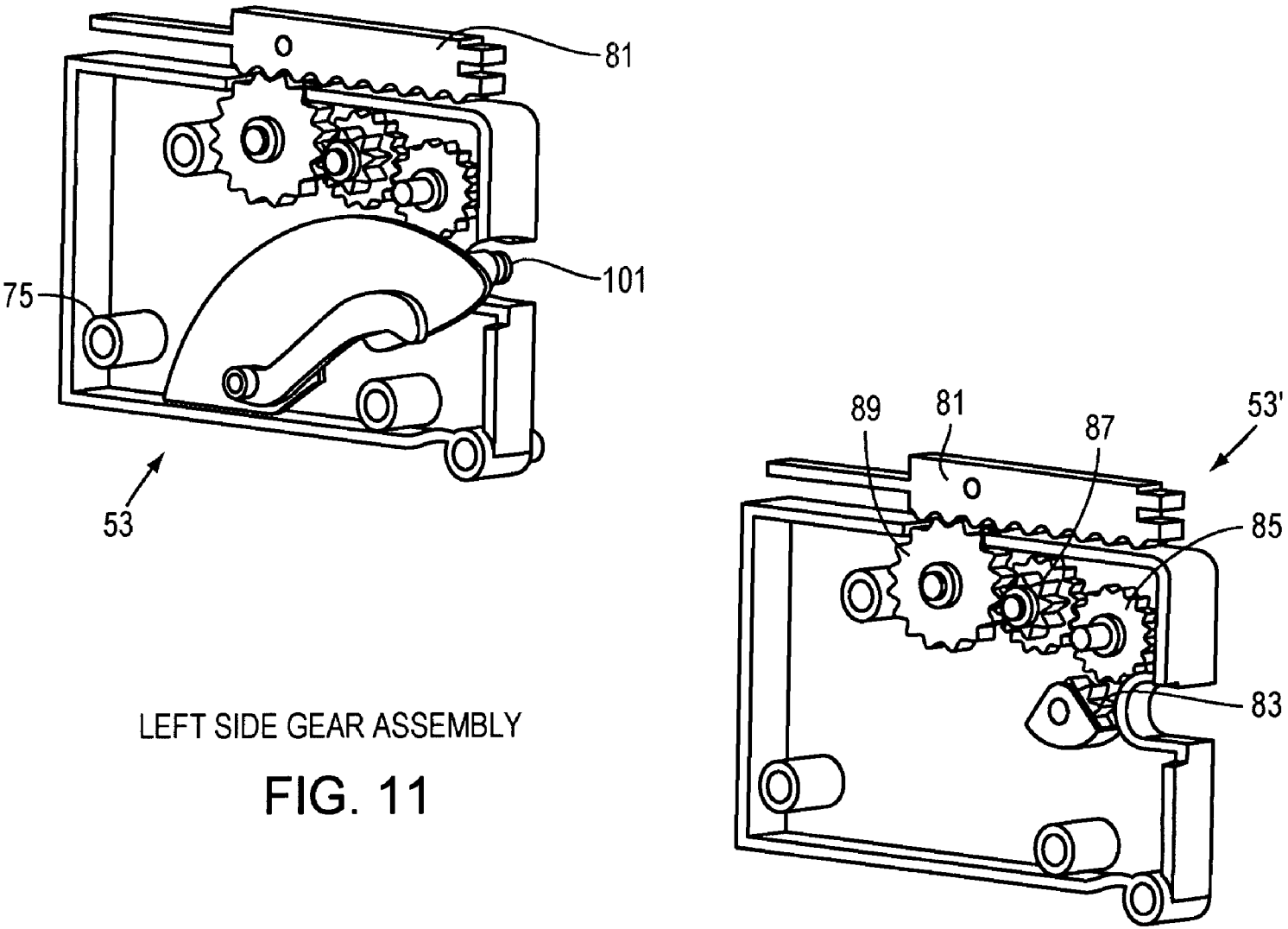
FIG. 11 is a disassembled view of the left side gear assembly.
Figure 12:
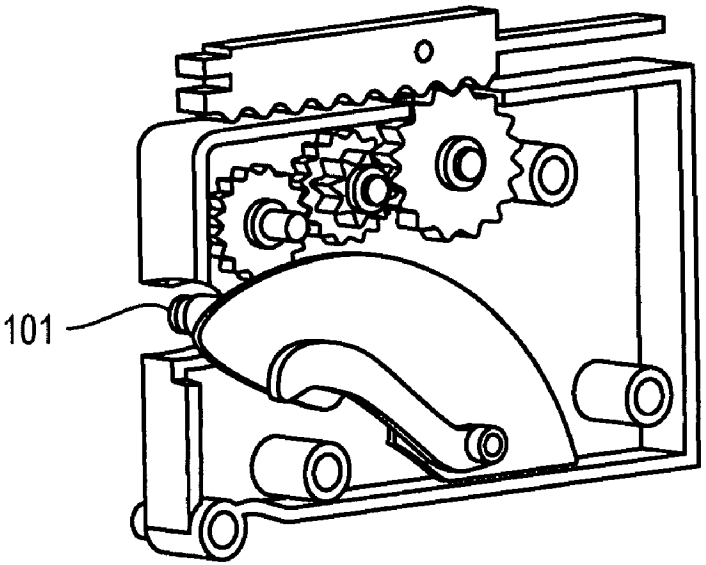
FIG. 12 is a disassembled view of the right side gear assembly.
Figure 12:
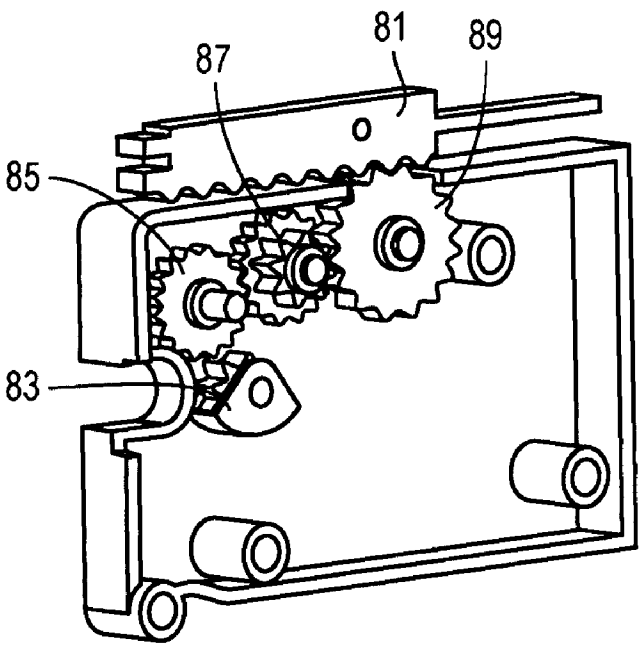

FIGS. 11 and 12 show the left and right side gear assembly in two views respectively with both the cover member 75 thereon and with it removed. The left side gear assembly 53 with the cover 75 attached includes a pin member 101 which supports the tray 61, which in turn, when assembled engages with partial gear 83 through an extension thereof (not shown). The gear assembly 53 is also connected through a plurality of gears with a fixed gear beam 81 which bears on gear 89. The fixed gear beams 81 on each side, as may be appreciated are received in the gear housing 51 within partially closed sections 52 to be firmly retained therein as shown in FIGS. 6, 7, 8, 9 and 10. Thus, when the tray 61 is pivoted from its first position, it causes a member thereof (not shown) to engage with partial gear 83 which in turn engages with gear 85, which turns gear 87 thereby turning gear 89 to engage the teeth of the fixed gear beam 81. As will be appreciated by those of ordinary skill in the art, through this motion, the gear mechanisms 53 are urged outwardly away from the inside of the tray gear housing 51 into the second position or back into the tray gear housing 51 if the tray 61 is moved back to the first position.

The amount of movement outwardly from the tray gear housing 51 is adjusted depending on the thickness 27 of the door panel 25 within which the dispenser assembly 11 is located (see FIG. 3) and can be controlled by appropriate stops associated with the gear mechanisms 53 or the guide members 81. While the dispenser assembly 11 can be manufactured with varying gaps 31 to accommodate different specific door panel thicknesses 27, such individual assemblies 11 would increase the expense of manufacturing the door assemblies 11. The gap 31 also can be manufactured to provide a sufficient gap to accommodate the largest thickness of the door panel 25. However, the gear assembly 53 provides the greatest flexibility and support to accommodate varying door panel thicknesses 27.

Having thus generally described the invention, the same will become better understood from the appended claims in which it is set forth in a non-limiting manner.

What is claimed is:

1. A door dispenser assembly, comprising:

a housing having a cavity therein for receiving a container for having a substance dispensed into the container;

a control mechanism for said housing for controlling dispensing of substances dispensed thereby, and a dispenser associated with said control mechanism for dispensing said substances therethrough into said cavity;

a tray pivotable between a first position in which said tray is received in said cavity in said housing in a manner providing a support surface at an upper level for a container to be supported thereon, and a second position in which said tray is pivoted outside of said housing with said support surface removed from said cavity to provide additional clearance for allowing a container to be supported within said cavity at a lower level than said upper level within said cavity.

2. The door dispenser assembly of claim 1, wherein said support surface of said tray is perforated to allow dispensed substances which are in liquid form to pass therethrough when not received within a container.

3. The door dispenser assembly of claim 2, wherein said housing has a support surface at the bottom of said cavity which provides the support surface at the lower level for a container.

4. The door dispenser assembly of claim 3, further comprising a drip tray removably supported on said support surface of said cavity.

5. The door dispenser assembly of claim 1, wherein said tray is removable from said housing.

6. The door dispenser assembly of claim 1, wherein said tray is of an L-shaped construction, with one of the legs of the L of the tray presenting the support surface when in the first position and the other leg of the tray presenting a front panel of the housing when in the first position.

7. The door dispenser assembly of claim 6, wherein said tray is constructed to have a gap at an end connecting to the housing to provide a sufficient clearance to clear the assembly housing when the tray is rotated into said second position.

8. A door dispenser assembly, comprising:

a housing having a cavity therein for receiving a container for having a substance dispensed into the container;

a control mechanism for said housing for controlling dispensing of substances dispensed thereby, and a dispenser associated with said control mechanism for dispensing said substance therethrough into said cavity; and a tray mechanism with a tray pivotable between a first position in which said tray is received in said cavity in said housing in a manner providing a support surface at an upper level for a container to be supported thereon, and a second position in which said tray is pivoted outside of said housing with said support surface removed from said cavity at a lower level than said upper level within said cavity, and said tray mechanism comprising a drive for causing the tray to be removed out from and away from the cavity a predetermined distance at its connection thereto when pivoted from said first position into said second position.

9. The door dispenser assembly of claim 8, wherein said tray mechanism comprises:

a tray gear housing received in said cavity and having a pair of gear drives respectively located adjacent to sides thereof, said tray being connected to said gear drives and said tray gear housing in a manner in which the tray is received within the cavity with the position providing said support surface at an upper level located at the top of said tray gear housing, and when said tray is moved into said second position, the tray is forced a predetermined distance out from and away from the cavity and the tray gear housing by said drive gears, which are caused, by said pivoting into the second position, to also be moved and project out a predetermined distance from the tray gear housing and the cavity.

10. The door dispenser of claim 9, further comprising a pair of fixed gear beams retained within the tray gear housing in bearing contact with a respective one of said pair of gear drives such that when the tray is moved, each bears against a respective one of said pair of gear beams for causing the gear drives to move inwardly and outwardly from the tray gear housing.

11. The door dispenser assembly of claim 8, wherein said support surface of said tray is perforated to allow dispensed substances which are in liquid form to pass therethrough when not received within a container.

12. The door dispenser assembly of claim 9, wherein said tray gear housing has a support surface at the bottom of said cavity which provides the support surface at the lower level.

13. The door dispenser assembly of claim 12, further comprising a drip tray removably supported on said support surface of said cavity.

14. The door dispenser assembly of claim 13, wherein said tray is of a flap construction in an L-shaped with one of the legs of the L of tray presenting the support surface when in the first position and the other leg of the tray presenting a front panel of the housing when in the first position.

15. The door dispenser assembly of claim 8, wherein said dispenser is constructed for dispensing at least water, ice and crushed ice, and said control mechanism includes plural control press buttons for selecting a mode of dispensing of said dispenser.

* * * * *